US006872030B2

(12) United States Patent
Ashton et al.

(10) Patent No.: US 6,872,030 B2
(45) Date of Patent: Mar. 29, 2005

(54) WOOD SUPPORT PILING WITH COMPOSITE WRAPPINGS AND METHOD FOR REINFORCING THE SAME

(75) Inventors: Bret H. Ashton, Gunnison, UT (US); Clint H. Ashton, Gunnison, UT (US)

(73) Assignee: North Pacific Group, Inc., Portland, OR (US)

( * ) Notice: Subject to any disclaimer, the term of this patent is extended or adjusted under 35 U.S.C. 154(b) by 0 days.

(21) Appl. No.: 10/057,086

(22) Filed: Jan. 25, 2002

(65) Prior Publication Data

US 2003/0143037 A1 Jul. 31, 2003

(51) Int. Cl.[7] ..... E02D 5/60; E04C 3/36

(52) U.S. Cl. ..... 405/211; 405/216; 52/736.1; 52/736.3

(58) Field of Search ..... 405/211, 211.1, 405/216, 231, 232, 257; 52/223.4, 301, 720.1, 721.2, 736.1, 736.3, 737.1; 428/36.3, 377, 378, 396, 398

(56) References Cited

U.S. PATENT DOCUMENTS

| | | | | | |
|---|---|---|---|---|---|
| 2,677,165 | A | * | 5/1954 | Copenhaver et al. | 405/257 |
| 2,870,793 | A | * | 1/1959 | Bailey | 52/40 |
| 4,694,622 | A | * | 9/1987 | Richard | 52/223.5 |
| 4,708,527 | A | | 11/1987 | Inhofe, Jr. et al. | |
| 4,779,389 | A | | 10/1988 | Landers | |
| 4,786,341 | A | * | 11/1988 | Kobatake et al. | 52/721.4 |
| 4,892,601 | A | | 1/1990 | Norwood | |
| 4,918,883 | A | | 4/1990 | Owen et al. | |
| 4,921,555 | A | | 5/1990 | Skiff | |
| 5,043,033 | A | * | 8/1991 | Fyfe | 405/216 |
| 5,138,806 | A | | 8/1992 | Marx et al. | |
| 5,175,973 | A | * | 1/1993 | Owen et al. | 405/216 |
| 5,218,810 | A | * | 6/1993 | Isley, Jr., | 52/736.3 |
| 5,326,410 | A | | 7/1994 | Boyles | |
| 5,516,236 | A | | 5/1996 | Williams et al. | |
| 5,542,229 | A | * | 8/1996 | Saito et al. | 52/731.2 |
| 5,555,696 | A | * | 9/1996 | Morrison et al. | 52/737.1 |
| 5,573,354 | A | | 11/1996 | Koch | |
| 5,586,838 | A | | 12/1996 | Walsh | |
| 5,591,265 | A | | 1/1997 | Tusch | |
| 5,607,627 | A | * | 3/1997 | Berkeley et al. | 261/91 |
| 6,135,675 | A | * | 10/2000 | Moreau | 405/284 |
| 6,363,681 | B1 | * | 4/2002 | Neuner | 52/736.1 |
| 6,367,225 | B1 | * | 4/2002 | Ashton | 52/736.1 |
| 2002/0095905 | A1 | * | 7/2002 | Fawley | 52/736.3 |

FOREIGN PATENT DOCUMENTS

| | | | | |
|---|---|---|---|---|
| EP | 173446 | * | 3/1986 | 405/211 |

OTHER PUBLICATIONS

Update: Utility distribution poles; Composites Technology (Jul./Aug. 1996) p. 15.

* cited by examiner

*Primary Examiner*—Jong-Suk James Lee
(74) *Attorney, Agent, or Firm*—Schwabe, Williamson & Wyatt, P.C.

(57) ABSTRACT

A wood support piling is reinforced by a composite wrapping. The composite wrapping is formed on the wood piling by a filament winding process. Filament strands are impregnated with resin and wrapped around the wood piling under tension. The resin is allowed to cure to form a seamless layer which is uniform in thickness and materials. The composite wrapping is bonded to the wood piling and applies a compressive force on the wood piling to improve its strength characteristics. The composite wrapping may be applied to a portion of the wood piling where reinforcement is needed so that the piling can be manufactured economically. The composite wrapping protects the piling against deterioration and reduces the need for chemical preservatives which are harmful to the environment.

69 Claims, 2 Drawing Sheets

WOOD SUPPORT PILING WITH COMPOSITE WRAPPINGS AND METHOD FOR REINFORCING THE SAME

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. The Field of the Invention

The present invention relates generally to column support structures, and more particularly, but not necessarily entirely, to reinforcing wood support pilings with composite wrapping.

2. Description of Related Art

The use of column support structures is known in the art for applications such as in utility poles, bridges, piers, and buildings. Wooden column supports are often made from logs treated with one or more preservatives such as creosote. Wooden column supports, or pilings, are often desirable since they are less expensive and readily obtainable compared to pilings made from concrete, metal or composite materials. Although the wooden support pilings are treated with a preservative, they are often subjected to rot, decomposition, damage caused by insects such as termites, or damage caused by wildlife such as woodpeckers, during the life of the piling. Typically, the damage is either an exterior area of decomposition caused by chemical or mechanical action, or internal decomposition which is enabled if the wood preservative does not penetrate the center of the piling. The internal decomposition often occurs near or slightly below the ground line. This can weaken the piling to an extent that it must be repaired or replaced. Furthermore, many of the preservatives added to the wood are toxic to the environment.

Attempts have been made in the prior art to address the problem of decomposed wood pilings, by repairing the piling while it is in place. For example, U.S. Pat. No. 5,326,410 (granted Jul. 5, 1994 to Boyles) discloses a system of reinforcing a structural support in place, by excavating the earth about the pole, applying a coating of curable resin and wrapping a plurality of layers of a fiberglass fabric around the pole. This method is expensive since a crew must transport equipment and supplies to the site of the pole, and perform the repair by hand, without the aid of wrapping machinery. Furthermore, a pole repaired on site is not as strong as a pole prepared with a filament wound covering in a shop in the manner of the present invention, since the filament wound covering can be made to radially compress the pole and would reduce or prevent decomposition and other weakening action in the first place. Radial compression of the pole increases the pole strength and prevents the pole from splitting apart.

U.S. Pat. No. 5,586,838 (granted Dec. 24, 1996 to Walsh) discloses a post for resisting deterioration which is prepared prior to installation in a pier structure. The post is prepared by wrapping mesh layers and matrix resin layers around the post to completely encapsulate the post. However, this method of wrapping the post does not increase the strength of the post as much as a filament winding process, since the filament winding process allows a radial compression force to be applied to the post by the reinforcement layer.

The prior art is thus characterized by several disadvantages that are addressed by the present invention. The present invention minimizes, and in some aspects eliminates, the above-mentioned failures, and other problems, by utilizing the methods and structural features described herein.

In view of the foregoing state of the art, it would be an advancement in the art to provide a wood support piling with a composite wrapping which is economical in design and manufacture, and which is resistant to decomposition. It would be a further advancement in the art to provide a wood support piling with a composite wrapping which provides a radial compressive force to the piling which increases the strength of the piling. It would also be an advancement in the art to provide a wood support piling with a composite wrapping which is not toxic to the environment.

BRIEF DESCRIPTION OF THE DRAWINGS

The features and advantages of the invention will become apparent from a consideration of the subsequent detailed description presented in connection with the accompanying drawings in which.

DETAILED DESCRIPTION OF THE PREFERRED EMBODIMENTS

Figure 1:
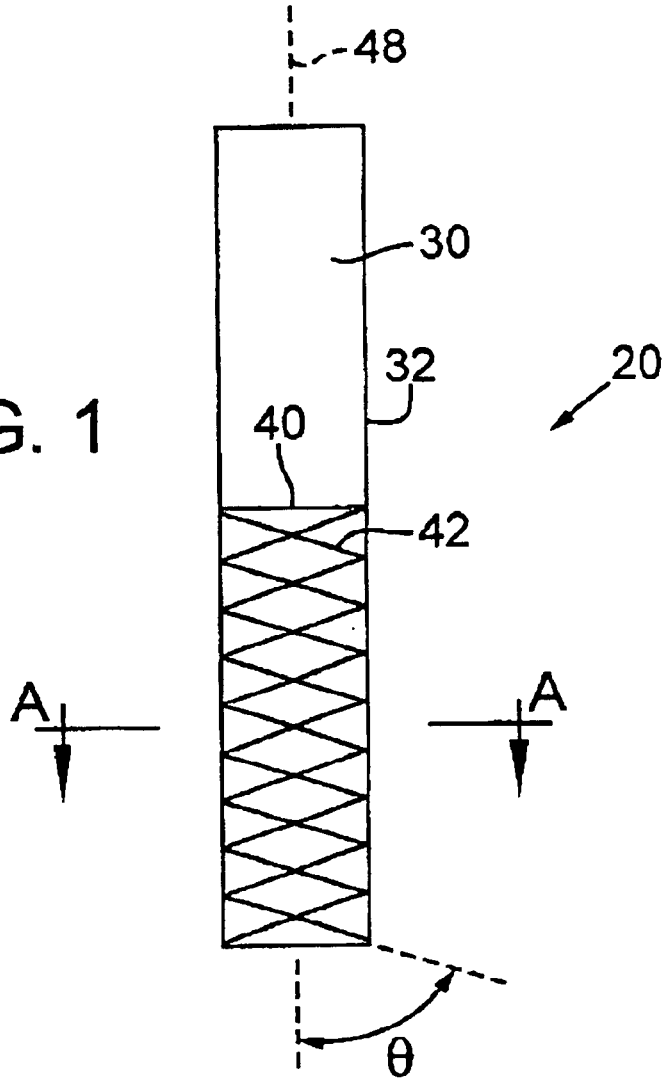
FIG. 1 is a side view of a wood support piling with a composite wrapping made in accordance with the principles of the present invention.
Figure 2:
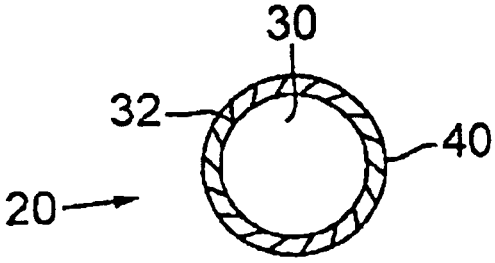
FIG. 2 is a cross-sectional view of the wood support piling with a composite wrapping of FIG. 1, taken along section A—A.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

The features and advantages of the invention will be set forth in the description below, and in part will be apparent from the description, or may be learned by the practice of the invention without undue experimentation. The features and advantages of the invention may be realized and obtained by means of the instruments and combinations particularly pointed out in the appended claims.

Referring now to FIG. 1, a reinforced wood support piling 20 is shown. The reinforced wood support piling 20 includes a non-hollow elongate shaft 30, which is preferably a wooden pole, having an exterior surface 32. The shaft 30 is preferably at least 10 feet long, and more preferably at least 25–30 feet long. A composite wrapping 40 encircles the exterior surface 32 along at least a portion of the length of the elongate shaft 30. The composite wrapping 40 is preferably bonded to the elongate shaft 30 to remain affixed thereto. The bond may be an adhesive bond or a mechanical bond, for example, or other type of bond known to those skilled in the art so that the composite wrapping 40 remains attached to the elongate shaft 30. For example, a bonding agent of the composite may be allowed to seep between the wood fibers in the pole 30 to interlock with the wood fibers to form a mechanical bond.

Preferably, the composite wrapping 40 covers a bottom portion of the elongate shaft 30 in an area near where the ground surface may be located when the reinforced wood support piling 20 is installed. For example, the composite wrapping preferably covers a portion of the elongate shaft to extend approximately two feet below the ground surface up to four feet above the ground surface, a section sometimes called the "transition zone." The transition zone is an area in which wood poles commonly deteriorate due to exposure to moisture or water vapor, micro-organisms, insects, or animals, for example. Microorganisms capable of infesting the wood shaft 30 do not survive below the transition zone and the size and location of the zone may vary. By reinforcing this portion of the wood support piling 20, the need for costly repairs after the piling is installed is reduced. Furthermore, the cost of the reinforced wood support piling 20 is less than poles made completely of composite materials.

Figure 4:
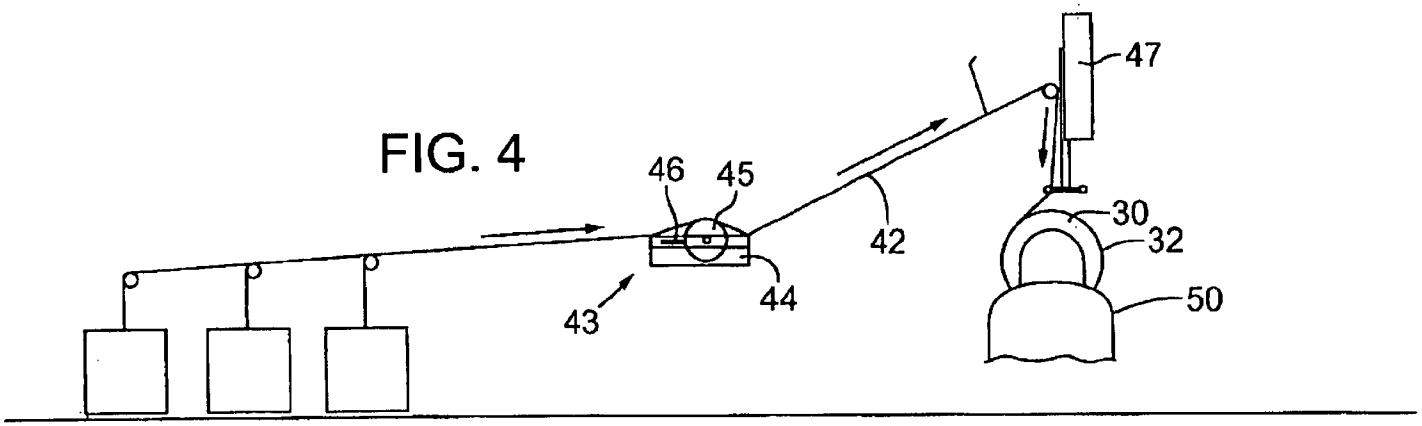
FIG. 4 is a side cross-sectional view of a filament winding apparatus and impregnator in accordance with one embodiment of the present invention.
Figure 3:
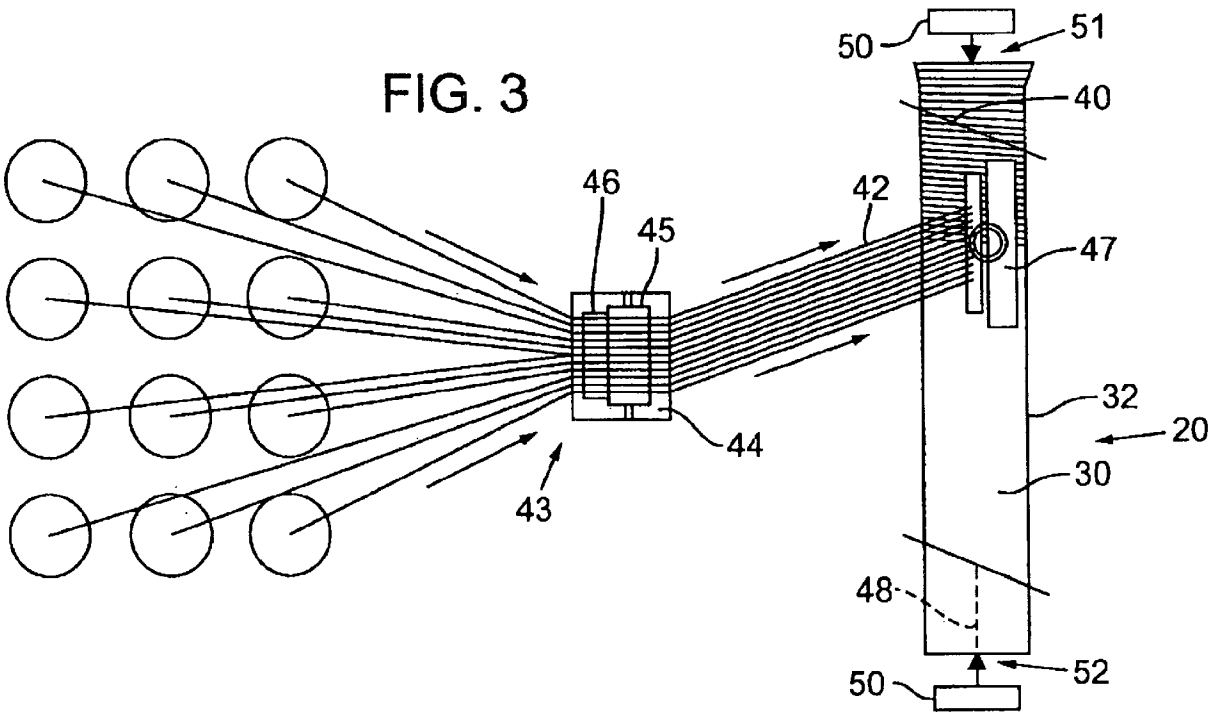
FIG. 3 is a top view of a filament winding apparatus and impregnator in accordance with one embodiment of the present invention.

The reinforced wood support piling 20 is manufactured by a filament winding process as shown in FIGS. 3 and 4. This allows the reinforced wood support piling 20 to be mass-produced economically, and allows substantial control over the manufacturing to improve quality. Thus, this method provides advantages over methods that attempt to repair deteriorated poles while they are in place in the ground. Filament winding is a reinforced plastic process employing a series of continuous, resin-impregnated fibers 42 or strands applied to the rotating elongate shaft 30. The strands 42 may be impregnated with the resin by passing through an impregnator 43, which may consist of a resin bath 44 having rollers 45 and doctor blades 46, to saturate the strands 42 with the resin. The resin-impregnated fibers 42 may be installed in a predetermined geometrical pattern under controlled tension, which then cures to form the composite wrapping 40 with a high strength-to-weight ratio, good corrosion resistance, thermal and impact resistance, and a high strength-to-thickness ratio. The filaments 42 are preferably composed of fiberglass, however, other materials known to those skilled in the art may be used within the scope of the present invention. Suitable resins include epoxies, polyesters, polyimides, silicones, polyethylenes, and phenolics or any other such resin known to those skilled in the art. The particular resin used may be selected to be suitable for the intended purpose based on various factors such as cost, strength, durability, fire retardation characteristics, or appearance, for example.

Equipment for the filament winding process may resemble the conventional machine shop lathe 50. The elongate shaft 30 may be positioned between the headstock 51 and tailstock 52 and rotated so that tow threads or fibers 42, after being saturated with plastic binding material, may be pulled onto the exterior surface 32 of the shaft 30. A carriage 47 dispenses the reinforcement fibers 42 and moves in a direction parallel to the longitudinal axis 48 of the elongate shaft 30. The linear speed of the carriage may be synchronized with the rotational speed of the elongate shaft 30 so that the reinforcement fibers 42 are applied at some predetermined and controlled position and orientation. Preferably, the tow threads or fibers 42 are applied to the wood pole 30 to form windings which form an angle θ as shown in FIG. 1 with respect to the longitudinal axis 48 of the shaft 30 within a range of sixty to ninety degrees (60°–90°). Most preferably, the angle of the windings is approximately eighty degrees (80°). The carriage 47 traverses back and forth for the length of travel required to produce the desired length of the composite wrapping 40, which would extend along part or all of the shaft 30. The number of passes of carriage travel and rotations of the elongate shaft 30 cooperate to establish the amount of composite material deposited onto the elongate shaft 30, and thereby the thickness of the composite wrapping 40.

One way in which the structural strength of the reinforced wood support piling 20 is improved is by maintaining the tension in the tow thread or fibers 42, during the filament-winding process of constructing the piling 20, within a range of preferably thirty to one-hundred twenty (30–120) pounds as a bundle (the tow thread of fibers 42 preferably comprising a bundle of preferably twelve tow strands). More preferably the tension in the tow threads is maintained at approximately one-hundred (100) pounds as a bundle, which increases the strength and durability of the wood support piling 20.

The composite wrapping 40 is preferably characterized by a single seamless layer having a substantially uniform thickness. Thus, although the composite wrapping 40 is made by the winding together of various strands 42 as discussed above, the strands are bonded together to form a single layer. The uniformly thick seamless layer of the present invention has advantageous handling, installing and protective characteristics over prior art reinforced poles having a longitudinal overlapping seam. The composite wrapping 40 also has an aesthetically pleasing appearance and can be colored as desired by placing a suitable dye in the resin.

After the composite wrapping 40 is installed, the resin in the wrapping is allowed to cure in any suitable manner of curing. As the resin cures, the composite wrapping 40 shrinks and preferably applies a radially compressive force on the elongate shaft 30. The compressive force increases the stiffness of the elongate shaft 30 to further improve the characteristics of the wood support piling 20. Preferably, the composite wrapping 40 is applied such that the stiffness of the wood support piling 20 is at least twenty (20) percent greater than the stiffness of the elongate shaft 30 alone, without the borded, reinforcing strength of the composite wrapping. More preferably, the composite wrapping 40 is applied such that the stiffness of the wood support piling 30 is at least thirty-eight (38) percent greater than the stiffness of the elongate shaft 30 alone. The increased stiffness provided by the composite wrapping 40 of the present invention provides many advantages. For example, wood poles are classified based on their minimum breaking strength. Wood poles failing to meet specific strength standards are not allowed for certain structural uses. Many wood poles are rejected for structural uses and are merely used for pulp. By increasing the strength characteristics of wood poles, the present invention allows a more economic, safe use of many of the weaker wood poles. For example, some wood poles that belong to the weaker classifications 1 and 2, as those classifications are known in the field, would previously be discarded as pulp wood, except that class 2 poles are sometimes upgraded by cutting them in shorter lengths. By operation of the present invention, class 1 poles and class 2 poles can be upgraded without decreasing their length by applying the composite wrapping 40 in accordance with the principle of the present invention. Also, the improved strength characteristics of wood piling increases the ability of the piling to be driven without peeling.

Additionally, wood poles tend to split over time. This splitting action causes the diameter of the wood poles to increase. The composite wrapping 40 holds the shaft 30 together so that the split does not cause a portion of the shaft 30 to break away. Furthermore, as the shaft 30 expands, the compressive force exerted by the composite wrapping increases to improve the strength of the pole. Preferably, the wood shaft or pole 30 is selected to have a moisture content of less than twenty-five (25) percent. Most preferably, the wood pole has a moisture content within a range of fifteen to twenty (15–20) percent. The preferred moisture content of the wood pole allows the composite wrapping 40 to reinforce the wood pole in the most optimal way presently known to applicants as the wood pole dries and splits.

The reinforced wood support piling 20 of the present invention is also beneficial to the environment since the use of hazardous chemicals as a preservative is eliminated or reduced. Seepage of chemicals into the environment is reduced, and likely eliminated, by use of the invention in comparison to preservative-treated wood poles.

In accordance with the above, it is a feature of the present invention to provide a wood support piling with a composite wrapping which is economical in design and manufacture. It is a further feature of the present invention, in accordance with one aspect thereof, to provide wood support piling with a composite wrapping which is resistant to decomposition. It is another feature of the present invention to provide such a wood support piling with a composite wrapping which provides a radial compressive force to the piling. It is an additional feature of the invention, in accordance with one aspect thereof, to provide a wood support piling with a composite wrapping which increases the strength of the piling. It is another feature of the present invention to provide a wood support piling which is not toxic to the environment. It is an additional feature of the invention to provide a wood support piling which is resistant to infestation.

The above and other features are realized in a specific illustrative embodiment of a wood support piling with a composite wrapping. The device includes a non-hollow elongate shaft having a length and an exterior surface covered by a composite wrapping. The composite wrapping encircles the exterior surface along at least a portion of the length. The composite wrapping forms a seamless layer of substantially uniform thickness and materials. The composite wrapping is formed on the wood piling by a filament winding process. Filament strands are impregnated with resin and wrapped around the wood piling under tension. The composite wrapping is bonded to the wood piling and applies a compressive force on the wood piling to improve the strength characteristics of the piling. The composite wrapping may be applied on a portion of the wood piling where reinforcement is needed so that the piling can be manufactured economically. The composite wrapping protects the piling against deterioration and reduces the need for chemical preservatives which are harmful to the environment.

In view of the foregoing, it will be appreciated that the present invention provides a wood support piling with a composite wrapping which is economical in design and manufacture, and which is resistant to decomposition. The present invention also provides a wood support piling with a composite wrapping which provides a radial compressive force to the piling to increase its strength. In addition, the present invention provides a wood support piling with a composite wrapping which is not toxic to the environment.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method for reinforcing a wood support member with a composite wrapping, said method comprising:

(A) applying a resin to a plurality of strands;

(B) joining said plurality of strands to said wood support member;

(C) forming at least one layer of said composite wrapping around said wood support member by rotating said wood support member and winding the plurality of strands thereon;

(D) allowing said resin to cure wherein said composite wrapping is bonded to said wood support member.

2. The method of claim 1 wherein (A) applying a resin to a plurality of strands comprises passing said plurality of strands through an impregnator.

3. The method of claim 2 wherein said impregnator comprises a resin bath, rollers, and doctor blades to saturate said plurality of strands with said resin.

4. The method of claim 1 further comprising passing said plurality of strands through a carriage, said carriage adapted to apply a tension to said plurality of strands against said wood support member.

5. The method of claim 4 wherein said tension is within a range of 30–120 pounds.

6. The method of claim 1 wherein said wood support member is at least 10 feet long.

7. The method of claim 6, wherein the wood piling is at least 25 feet long.

8. The method of claim 1 wherein said composite wrapping covers a portion of said wood support member adapted to be two feet below ground surface and four feet above ground surface when the wood support member is installed in the ground.

9. The method of claim 1 wherein the curing of said composite wrapping causes said composite wrapping to shrink to thereby radially compress said wood support member.

10. The method of claim 1 wherein the wood support member has a first stiffness prior to installation of the composite wrapping and a second stiffness after installation of the composite wrapping, and wherein the second stiffness is at least 20 percent greater than said first stiffness.

11. The method of claim 1 wherein said composite wrapping is a single, seamless layer.

12. The method of claim 1 further comprising selecting said wood support member having a moisture content of less than 25 percent.

13. The method of claim 1 wherein said wood support member has a moisture content within a range of 15 to 20 percent.

14. The method of claim 1 wherein said composite wrapping is bonded to said wood support piling by a mechanical bond.

15. The method of claim 1 further comprising winding said plurality of strands around said wood support piling at an angle within a range of 60–90 degrees with respect to a longitudinal axis of the wood support member.

16. The method of claim 15 wherein said angle is approximately 80 degrees.

17. A method for reinforcing a wood support member with a composite wrapping, said method comprising:

(A) placing said wood support piling on a filament winding apparatus;

(B) applying a resin to a plurality of strands;

(C) joining and applying said plurality of strands to said wood support piling to form at least one reinforcing layer, wherein said layer is bonded to said wood support piling.

18. The method of claim 17, wherein the part (c) further comprises forming a mechanical bond between the resin and fibers of the wood support piling.

19. A reinforced support piling comprising:

a non-hollow elongate shaft having a length and an exterior surface extending along said length; and a composite wrapping, said composite wrapping encircling said exterior surface along at least a portion of said length, said composite wrapping forming a layer of substantially uniform thickness and materials;

wherein said composite wrapping applies a radial compressive force upon said elongate shaft.

20. The reinforced support piling of claim 19 wherein said non-hollow elongate shaft is comprised of wood.

21. The reinforced support piling of claim 20 wherein said non-hollow elongate shaft has a moisture content of less than 25 percent.

22. The reinforced support piling of claim 21 wherein said non-hollow elongate shaft has a moisture content within a range of 15 to 20 percent.

23. The reinforced support piling of claim 19 wherein said non-hollow elongate shaft is comprised of a material known to crack, thereby increasing the radial compressive force.

24. The reinforced support piling of claim 19 wherein said composite wrapping is a single, seamless layer.

25. The reinforced support piling of claim 19 wherein said non-hollow elongate shaft is at least 10 feet long.

26. The reinforced support piling of claim 19 wherein said composite wrapping covers a portion of said non-hollow elongate shaft adapted to be two feet below ground surface and four feet above ground surface when the reinforced support piling is installed in the ground.

27. The reinforced support piling of claim 19 wherein the non-hollow elongate shaft has a first stiffness prior to installation of the composite wrapping and a second stiffness after installation of the composite wrapping, and wherein the second stiffness is at least 20 percent greater than said first stiffness.

28. The reinforced support piling of claim 19 wherein said composite wrapping is bonded to said non-hollow elongate shaft.

29. The reinforced support piling of claim 28 wherein said composite wrapping is bonded to said non-hollow elongate shaft by a mechanical bond.

30. A reinforced support pole comprising:

a non-hollow elongate shaft, said non-hollow elongate shaft having a length, an exterior surface extending along said length, and a first stiffness; and a composite wrapping, said composite wrapping encircling said exterior surface along at least a portion of said length and applying a radial compressive force on at least a portion of the elongate shaft;

wherein said reinforced support pole has a second stiffness, said second stiffness being at least 20 percent greater than said first stiffness.

31. The reinforced support piling of claim 30 wherein said second stiffness is at least 30 percent greater than said first stiffness.

32. The reinforced support piling of claim 30 wherein said second stiffness is at least 35 percent greater than said first stiffness.

33. The reinforced support piling of claim 30 wherein said second stiffness is at least 38 percent greater than said first stiffness.

34. The reinforced support piling of claim 30 wherein said non-hollow elongate shaft is comprised of wood.

35. The reinforced support piling of claim 34 wherein non-hollow elongate shaft has a moisture content of less than 25 percent.

36. The reinforced support piling of claim 35 wherein non-hollow elongate shaft has a moisture content within a range of 15 to 20 percent.

37. The reinforced support piling of claim 30 wherein said composite wrapping applies a radial compressive force upon said elongate shaft.

38. The reinforced support piling of claim 30 wherein said non-hollow elongate shaft is comprised of a material known to crack, to thereby increase the radial compressive force.

39. The reinforced support piling of claim 30 wherein said composite wrapping is a single, seamless layer.

40. The reinforced support piling of claim 30 wherein said non-hollow elongate shaft is at least 10 feet long.

41. The reinforced support piling of claim 30 wherein said composite wrapping covers a portion of said a non-hollow elongate shaft adapted to be two feet below ground surface and four feet above ground surface when the wood support piling is installed in the ground.

42. The reinforced support piling of claim 30 wherein said composite wrapping is bonded to said non-hollow elongate shaft.

43. The reinforced support piling of claim 42 wherein said composite wrapping is bonded to said non-hollow elongate shaft by a mechanical bond.

44. A method for reinforcing a wood pole with a composite wrapping, said method comprising:

(A) winding a multiple-tow bundle of fibers about said wood pole and maintaining said fibers under tension within a range of 30–120 pounds;

(B) undertaking part (A) above in a manner sufficient to form at least one layer of said composite wrapping of a filament-wound fiber-reinforced bonding agent;

wherein said composite wrapping is bonded to said wood pole.

45. The method of claim 44 wherein said tension is approximately 100 pounds.

46. The method of claim 44 wherein the bundle of fibers comprises twelve tow strands.

47. The method of claim 44 further comprising applying a resin to the multiple-tow bundle of fibers with an impregnator.

48. The method of claim 47 wherein said impregnator comprises a resin bath, rollers, and doctor blades to saturate said multiple-tow bundle of fibers with said resin.

49. The method of claim 44 further comprising passing said multiple-tow bundle of fibers through a carriage.

50. The method of claim 44 wherein said wood pole is at least 10 feet long.

51. The method of claim 44 wherein said composite wrapping covers a portion of said wood pole adapted to be two feet below ground surface and four feet above ground surface when the wood pole is installed in the ground.

52. The method of claim 44 wherein curing of said composite wrapping causes said composite wrapping to shrink to thereby radially compress said wood pole.

53. The method of claim 44 wherein the wood pole has a first stiffness prior to installation of the composite wrapping and a second stiffness after installation of the composite wrapping, and wherein the second stiffness is at least 20 percent greater than said first stiffness.

54. The method of claim 44 wherein said composite wrapping is a single, seamless layer.

55. The method of claim 44 further comprising selecting said wood pole having a moisture content of less than 25 percent.

56. The method of claim 44 wherein said wood pole has a moisture content within a range of 15 to 20 percent.

57. The method of claim 44 wherein said composite wrapping is bonded to said wood pole by a mechanical bond.

58. The method of claim 44 further comprising winding said multiple-tow bundle of fibers about said wood pole at an angle within a range of 60–90 degrees with respect to a longitudinal axis of the wood pole.

59. The method of claim 58 wherein said angle is approximately 80 degrees.

60. A method for reinforcing a wood support piling with a composite wrapping, said method comprising:

(A) selecting said wood support piling having a moisture content within a range of 15 to 20 percent;

(B) placing said wood support piling on a filament winding apparatus;

(C) applying a resin to a multiple-tow bundle of fibers by passing said multiple-tow bundle of fibers through an impregnator, said impregnator comprising a resin bath, rollers, and doctor blades;

(D) rotating said wood support piling;

(E) winding said multiple-tow bundle of fibers about said wood support piling and applying tension to said multiple-tow bundle of fibers during said winding such that said tension becomes applied to said wood support piling, and maintaining said fibers under tension within a range of 30–120 pounds, said multiple-tow bundle of fibers being wound about said wood support piling at an angle within a range of 60–90 degrees with respect to a longitudinal axis of the wood support piling;

(F) undertaking parts (C) to (E) above in a manner sufficient to form at least one layer of said composite wrapping of a filament-wound fiber-reinforced bonding agent;

(G) allowing said resin to cure wherein said composite wrapping is bonded to said wood support piling with a mechanical bond;

wherein the bundle of fibers comprises twelve tow strands;

wherein said wood piling is at least 10 feet long;

wherein said composite wrapping covers a portion of said wood support piling adapted to reside two feet below ground surface and four feet above ground surface when the wood support piling is installed in the ground;

wherein the curing of said composite wrapping causes said composite wrapping to shrink to thereby radially compress said wood support piling;

wherein said reinforced support piling has a second stiffness, said second stiffness being at least 35 percent greater than a first stiffness of said wood support piling without said composite wrapping;

wherein said composite wrapping forms a layer of substantially uniform thickness; and wherein said composite wrapping is a single, seamless layer.

61. A method for reinforcing a wood pole with a composite wrapping, said method comprising:

(A) selecting said wood pole having a moisture content of less than 25 percent;

(B) winding a multiple-tow bundle of fibers about said wood pole;

(C) undertaking part (B) above in a manner sufficient to form at least one layer of said composite wrapping of a filament-wound fiber-reinforced bonding agent.

62. The method of claim 61 wherein said moisture content is within a range of 10 to 25 percent.

63. The method of claim 61 wherein said moisture content is within a range of 15 to 20 percent.

64. The method of claim 61 wherein said at least one layer of composite wrapping is bonded to said wood pole by a mechanical bond.

65. The method 61 wherein the multiple tow bundle of fibers comprises windings that form an angle within a range of 60–90 degrees with respect to a longitudinal axis of said wood pole.

66. The method of claim 65, wherein the angle formed by the windings of the multiple tow bundle of fibers is approximately 80 degrees.

67. A reinforced wood support member comprising:

a non-hollow elongate shaft having a length and an exterior surface extending along said length;

a composite wrapping comprising one or more layers encircling the exterior surface along at least a portion of the length;

wherein at least one layer of the composite wrapping is formed by joining a plurality of strands impregnated with a resin and encircling the joined strands around the exterior surface in a helical manner.

68. The reinforced wood support member of claim 67, wherein the composite wrapping applies a radial compressive force upon the elongate shaft.

69. A method of reinforcing a wood support member, comprising:

Impregnating a plurality of individual strands with a resin;

winding the plurality of strands under tension around the member to form at least one layer of a composite wrapping.

* * * * *